United States Patent [19]

Pacione

[11] Patent Number: 4,909,554

[45] Date of Patent: Mar. 20, 1990

[54] LITTER PICKER

[76] Inventor: Albert J. Pacione, 656 Elm St., Englewood, Fla. 34223

[21] Appl. No.: 258,408

[22] Filed: Oct. 17, 1988

[51] Int. Cl.[4] ..... B08B 1/00

[52] U.S. Cl. ..... 294/61; 15/105; 15/119 A; 294/50.5

[58] Field of Search ..... 294/61, 50, 50.5, 50.6, 294/50.8, 19.1, 50.7, 51; 15/104 R, 169, 184, 105, 119 A; 56/400.8

[56] References Cited

U.S. PATENT DOCUMENTS

| | | | |
|---|---|---|---|
| 1,225,188 | 5/1917 | Smith | 294/50.5 |
| 2,500,647 | 3/1950 | Schulthess | 294/61 |
| 2,552,467 | 5/1951 | Thomas | 294/61 |
| 2,642,306 | 6/1953 | Beeler | 294/61 |
| 2,695,188 | 11/1954 | Klausman et al. | 294/61 |
| 2,738,215 | 3/1956 | Thompson | 294/61 |
| 2,800,354 | 7/1957 | King | 294/50.5 X |
| 2,804,336 | 8/1957 | Thompson | 294/61 |
| 3,152,788 | 10/1964 | Hardwidge | 294/50.5 X |
| 3,633,958 | 1/1972 | Mesrobian | 294/50 X |
| 4,502,722 | 3/1985 | Rocquin | 294/61 |

*Primary Examiner*—Johnny D. Cherry

*Attorney, Agent, or Firm*—Sughrue, Mion, Zinn, Macpeak & Seas

[57] ABSTRACT

A litter picking device in the form of a housing having at least one downwardly protruding spike and an upwardly extending handle secured thereto is provided with a knock-off plate slidable relative to the spike. According to one embodiment, the knock-off plate is connected to a rod which extends telescopically within the handle and which is normally spring biased in a direction to eject litter from the spike. A spring biased frictional latch is provided in the handle for engaging the rod to allow upward movement of the rod within the handle as the spike is forced into litter and which allows spring biased downward movement of the rod and knock-off plate upon pivotal movement of the latch out of frictional engagement with the rod. In another embodiment, the spike and knock-off plate are part of a kit adapted to replace the sponge assembly in a conventional roller-sponge mop. The spike is connected to a U-shaped channel member adapted to be secured to the rollers of such a mop and the knock-off plate is connected to the shaft member to which the sponge assembly would normally be connected for reciprocating.

5 Claims, 5 Drawing Sheets

LITTER PICKER

The present invention is directed to a device for picking up litter having at least one spike on the end of a support for penetrating the litter and a spring biased knock-off plate movable relative to the spike for disengaging the litter from the spike. More specifically, the present invention is directed to a conversion kit for converting a conventional, roller mop assembly into such a litter picker device and a spring biased, latch operated litter ejector arrangement for use with such litter picking devices.

BACKGROUND OF THE INVENTION

The use of trash pickers of the type having two telescopic rods with spikes attached to the end of one rod and a stripping plate attached to corresponding end of the other rod, are old and well known in the art. The U.S. Pat. No. 2,695.188, to Klausman et al., discloses such a trash picker, wherein a plurality of spikes are secured to a plate which in turn is secured to the end of a hollow, tubular rod. A stripper plate is disposed parallel to the spike mounting plate and is provided with a plurality of apertures through which the spikes extend. The stripper plate is secured to the end of a rod which is telescopically received within the hollow, tubular rod and a spring is provided for normally biasing the stripper plate into engagement with the spike supporting plate. A transverse pin extends through the rod connected to the stripper plate and extends through an elongated slot in the hollow, tubular rod. The pin is connected to a sleeve which is externally slidable on the hollow, tubular rod so that upon movement of the sleeve relative to the rod, the stripper plate can move the length of the spike to remove any trash impaled upon the spikes.

Roller mops are also old and well known, wherein a pair of rollers are mounted in spaced, parallel relation to each other on the end of a hollow, tubular rod. An elongated bar having a sponge attached thereto is disposed between the rollers and is connected to a second rod which is telescopically received within the hollow, tubular rod so that upon reciprocating movement of the two rods relative to each other, the sponge can be pulled between the rollers for the purpose of squeezing water from the sponge. The U.S. Pat. No. 4,333,198, to Vosbikian, discloses such a roller-sponge mop, the drawings of which are presented as FIGS. 1–4 of the present application.

FIGS. 1 and 2 of the present application disclose a sponge mop generally designated 10 which comprises a hollow, cylindrical, elongate body 12 at the bottom of which is connected a sponge squeezing assembly comprising an arched bridge 14, means for holding rollers in parallel spaced relation at right angles to the axis of the body, and a plurality of rollers. The body 12 terminates upwardly in a grip portion 44 to facilitate axially operation of the device. The bridge 14 includes a plurality of depending legs 16 which secure the roller shafts 18 and 20 below the body equidistantly from the axis of the body 12. The shafts 18 and 20 are outwardly equally spaced from the axis of the body 12 to secure the rollers in spaced relation from the body axis below the lower end of the body. A plurality of rollers 20 and 22 are rotatably mounted on the shafts 18 and 24.

A handle 26 is reciprocal within the interior of the body 12 and extends upwardly therefrom as best seen in FIG. 1. A sponge assembly connector in the form of a threaded stud 28 projects from the bottom of a plug 30 which is secured in the lower end of the handle 26. The replaceable sponge assembly in the form of a sponge 32 gripped by an elongated carrier 34 is threaded on the stud 28 thereby detachably connecting the sponge assembly to the handle.

The normal operating position of the sponge is shown in FIG. 3, wherein the sponge carrier 34 is located between the rollers 22 and 24. Upon pulling the handle 26 upwardly as viewed in FIG. 4, relative to the body 12, the sponge 32 is pulled upwardly between the rollers 22 and 24 to squeeze the excess water from the sponge.

Applicant's copending application, Ser. No. 102,167 filed Sept. 29, 1987, now U.S. Pat. No. 4,856,835, discloses a number of attachments for the conventional squeeze mop to convert the conventional squeeze mop into a litter picker device. The present application discloses two additional forms of litter picking devices based on the construction of the roller-sponge mop of the type disclosed in U.S. Pat. No. 4,333,198.

SUMMARY OF THE INVENTION

The present invention provides a new and improved litter picking device comprising a conversion kit for converting a conventional roller-sponge mop into a litter picker which involves a simple substitution of parts.

The present invention provides a new and improved litter picking device in the form of a conversion kit comprising an elongated U-shaped channel member adapted to fit over the parallel rollers of a conventional roller-sponge mop having the sponge assembly removed therefrom, securing means for connecting the U-shaped channel member to said rollers, spike means protruding downwardly from the base of the U-shaped channel, attachment bar extending parallel to and above said U-shaped channel member having means for securing said bar to the lower end of an inner telescopic handle of a conventional roller mop in lieu of a sponge assembly, a knock-off plate disposed adjacent the bottom of said U-shaped channel member having aperture means through which said spike means protrude, connecting means interconnecting said bar and said plate and spring means disposed between said bar and the U-shaped channel member to normally bias said knock-off plate into engagement with the U-shaped channel member.

The present invention is directed to a new and improved litter picking device comprising a hollow, elongated tubular handle having a housing secured at one end thereof, spike means connected to said housing and extending downwardly in a direction substantially parallel to the axis of said handle, knock-off means slidably mounted for movement relative to said housing and having aperture means through which said spike means protrude, a rod secured to said knock-off means and extending through said hollow, tubular handle, latch means supported by said handle and having an aperture through which said rod protrudes for normally preventing axial movement of said rod in the direction of said spike means and spring means for biasing said knock-off plate means away from said handle upon release of said latch means to discharge litter from said spike means.

The foregoing and other objects, features and advantages of the invention will be apparent from the following, more particular description of a preferred embodiment of the invention as illustrated in the accompanying drawings.

DETAILED DESCRIPTION OF THE INVENTION

Figure 6:
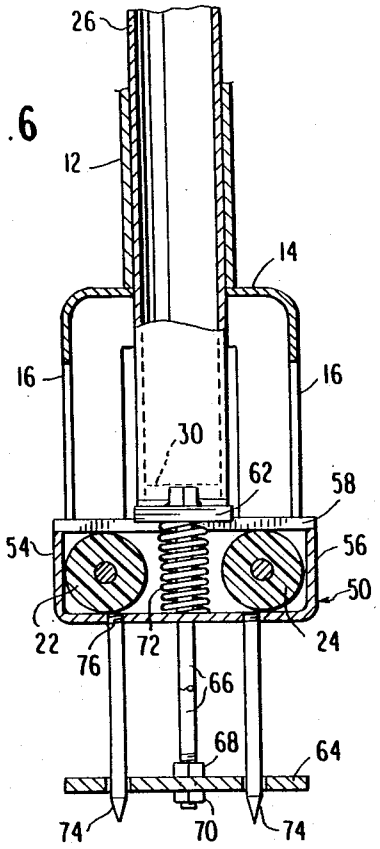
FIG. 6 is an end elevation view, partly in section of the conversion kit as shown in FIG. 5.
Figure 5:
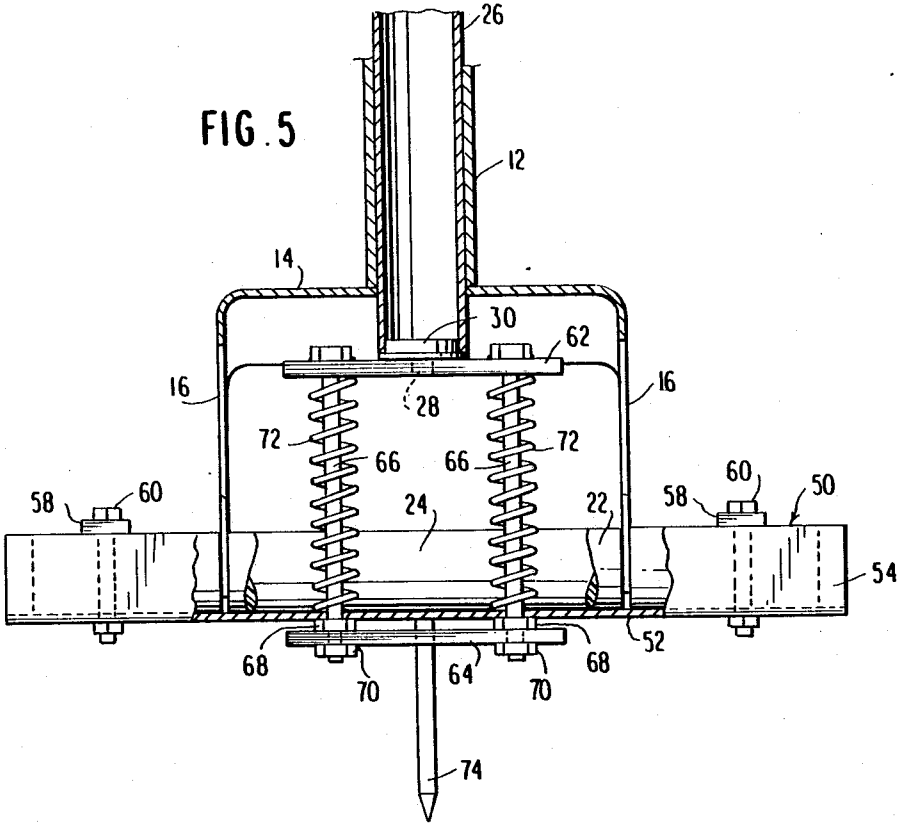
FIG. 5 is a side elevation view, partly in section showing the litter picking conversion kit mounted on the roller mop device of FIGS. 1–4 in lieu of the sponge assembly.

A conversion kit is illustrated in FIGS. 5 and 6 of the present application which is suitable for converting the sponge-roller mop shown in FIGS. 1–4 inclusive into a litter picker. Accordingly, those portions of the device which remain the same will bear the same reference numerals.

The conversion kit is comprised of an elongated U-shaped channel member 50 comprised of a base 52 and two upstanding leg portions 54 and 56. The U-shaped channel member fits over the parallel rollers 22 and 24 after the sponge assembly 32,34 has been detached from the threaded stud 28. The U-shaped channel member 50 is held on the rollers by means of a pair of cross bars 58 which extend across the upper edges of the legs 54 and 56 and are secured to the base 52 by means of a pair of nut and bolt assemblies 60 with the bolts extending downwardly between the rollers 22 and 24.

A support bar 62 having a central threaded aperture is secured on the threaded stud 28 of the conventional sponge-roller mop, a knock-off plate 64 is rigidly but detachably connected to the support bar 62 by means of a pair of bolts or rods 66 which are permanently secured to the support bar 62 by welding on the like. The lower ends of the rods 66 are threaded and a pair of nuts 68 and 70 are threaded on the ends of the rod or bolts 66 on opposite sides of the knock-off plate 64 as best shown in FIG. 6. A pair of springs 72 surround the bolts or rods 66 and extend between the support bar 62 and the base 52 of the U-shaped channel member 50.

Thus, in order to convert the sponge-roller mop as shown in FIGS. 1–4 to a litter picking device, it is only necessary to unscrew the sponge assembly 32,34 from the threaded stud 28 and slide the sponge assembly outwardly from between the rollers 22 and 24. The crossbar 62 having the rods or bolts 66 secured thereto is then connected to the threaded stud 28 by rotation of the tubular shaft 26 in which the threaded stud 28 is supported by means of a plug 30. The U-shaped channel member 50 is then placed over the rollers 22 and 24 with the springs 72 in position on the bolts 66 and the ends of the bolts 66 extending through aligned apertures in the base 52 of the U-shaped channel member 50. The U-shaped channel member is then secured to the rollers by means of the crossbars 58 and the nut and bolt assemblies 60. A nut 68 is then threaded on the lower end of each bolt 66 and the knock-off plate 64 is inserted over the spikes 74 which depends from the lower surface of the base 52 and over the ends of the bolts 66. The nuts 70 are then secured to the lower ends of the bolts 66 to secure the knock-off plate 64 on the ends of the bolts 66. While two spikes have been shown in the present embodiment it is obvious that any number of spikes could be provided and complementary apertures be provided for each spike in the knock-off plate 64. The spikes 74 can be secured by any suitable means to the base 52 of the U-shaped channel member 50 such as welding or the like. As shown in FIG. 6, the spikes 74 are provided with threaded end portions 76 which are screwed into correspondingly threaded apertures in the base 52. Thus a conversion kit is provided for quickly and easily converting a conventional roller-sponge mop to a litter picking device.

Figure 7:
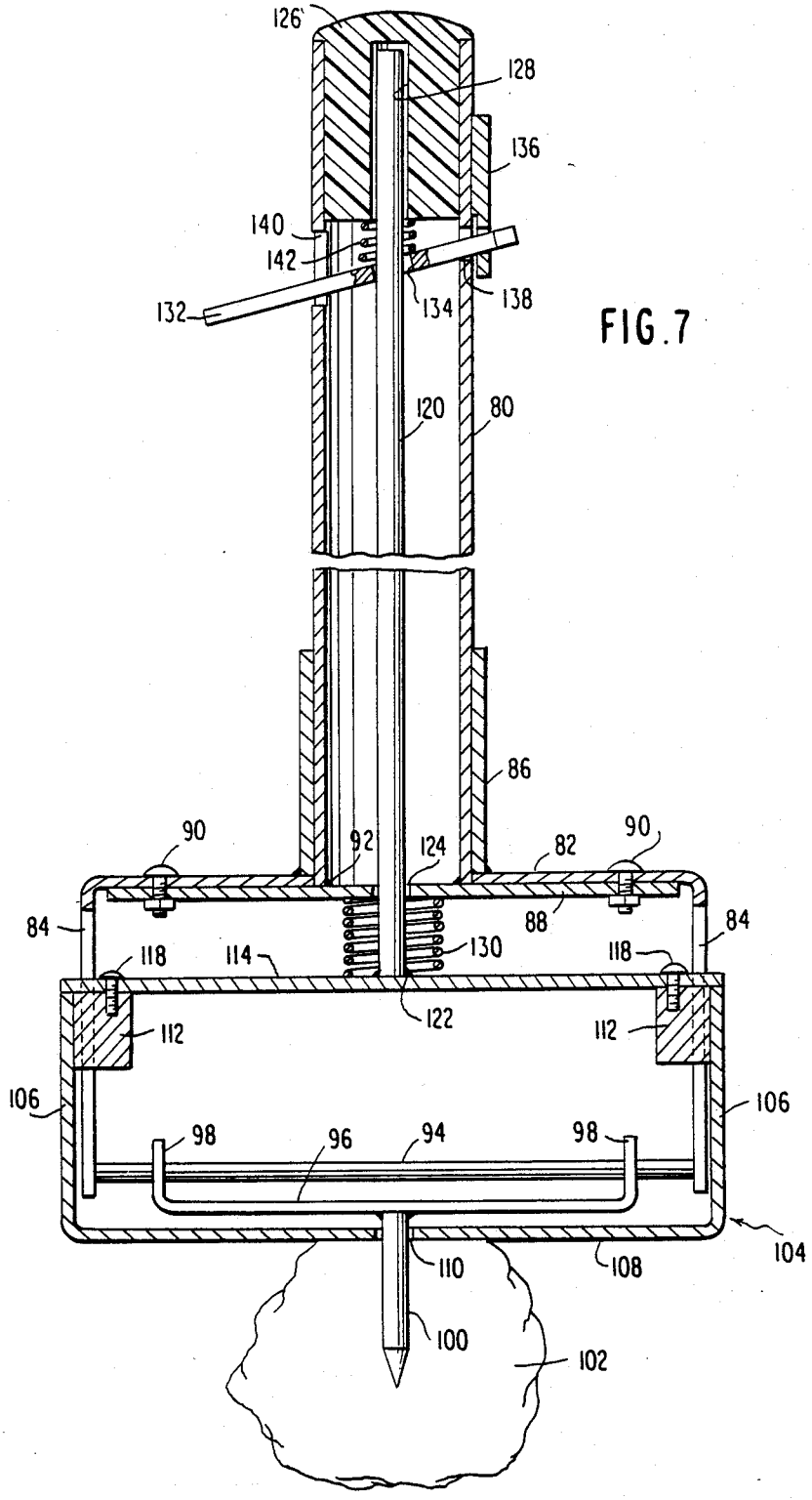
FIG. 7 is a side elevation view of another embodiment of a litter picking device according to the present invention with the knock-off plate in retracted position due to the presence of litter on the spike.
Figure 8:
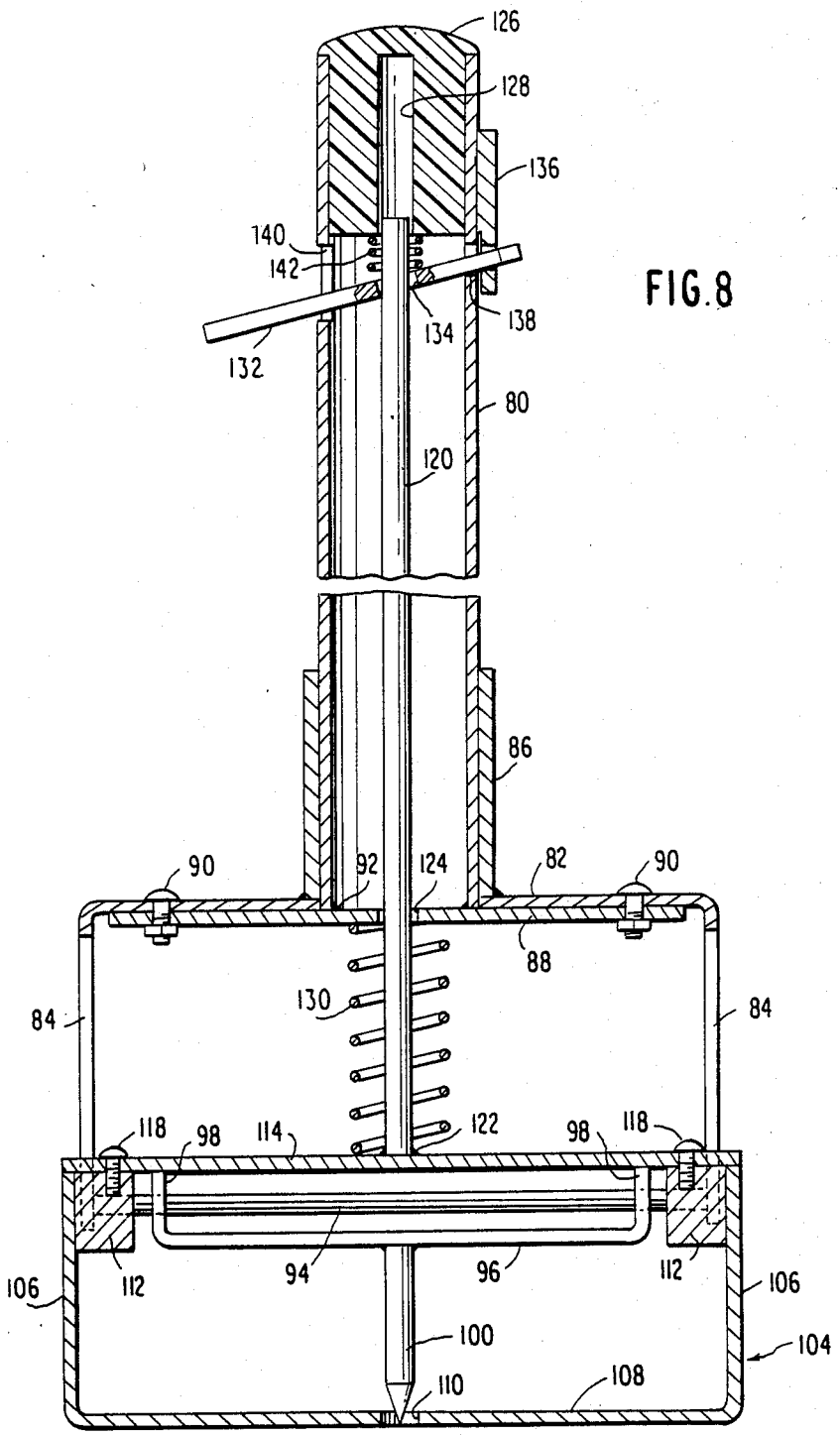
FIG. 8 is a side elevation view similar to FIG. 7 with the knock-off plate in the extended position adjacent the tip of the spike.

The litter picking device according to the embodiment shown in FIGS. 7 and 8 is not a true conversion device for a conventional roller-sponge mop, but the basic frame of the litter picking device is identical in some aspects to the basic frame of a conventional roller-sponge mop shown in FIGS. 1–4.

Figure 1:
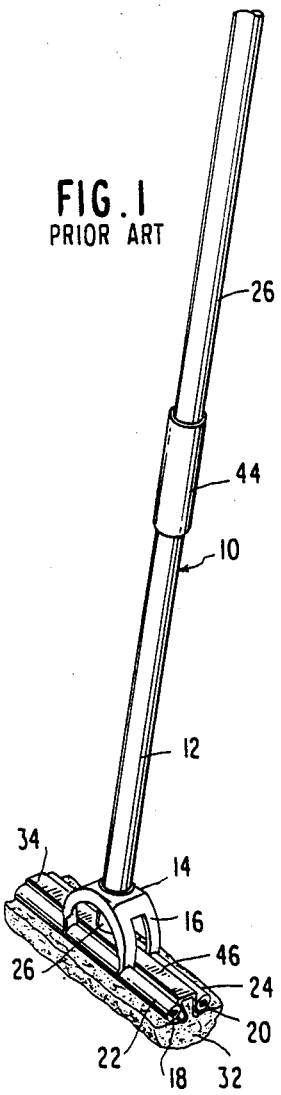
FIG. 1 PRIOR ART
FIG. 1 is a perspective view of a prior art sponge-roller mop adapted to be used with the conversion kit according to the present invention.
Figure 2:
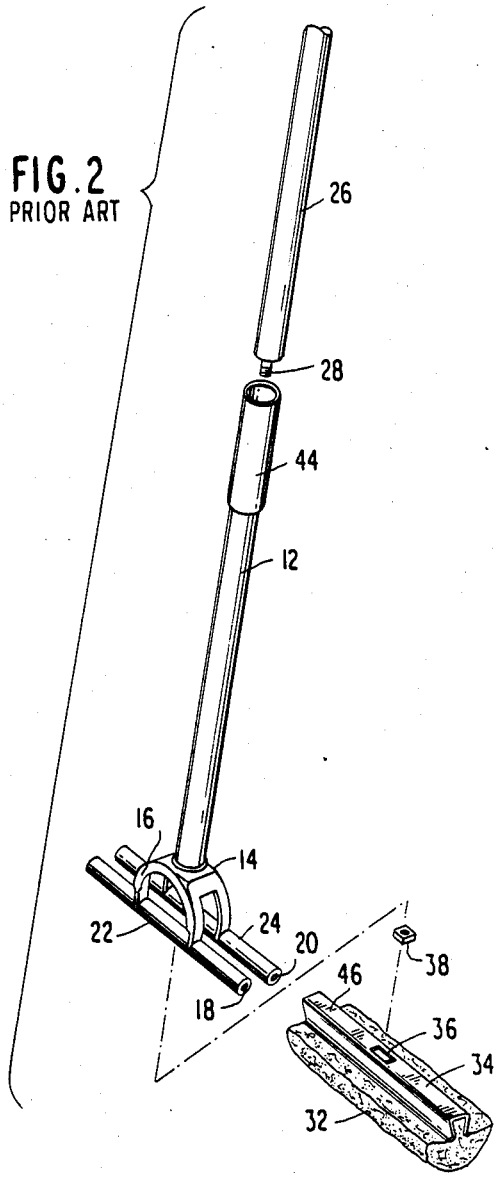
FIG. 2 PRIOR ART
FIG. 2 is an exploding perspective view of the sponge-roller mop of FIG. 1.
Figure 3:
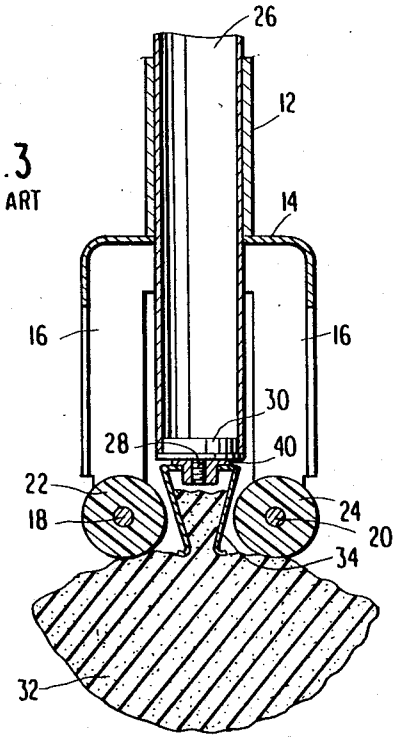
FIG. 3 PRIOR ART
FIG. 3 is an enlarged cross-sectional end view of the sponge and roller assembly showing the extended position of the sponge.
Figure 4:
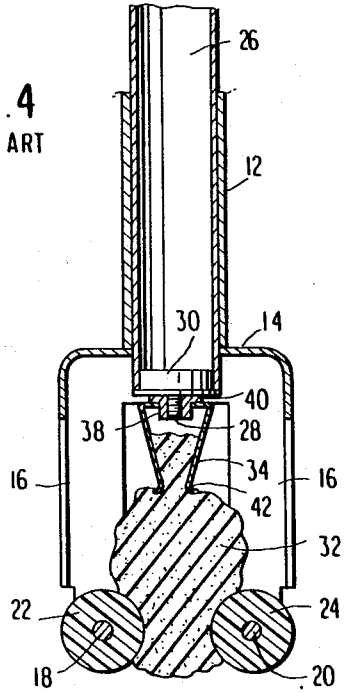
FIG. 4 PRIOR ART
FIG. 4 is an enlarged cross-sectional view similar to FIG. 3 showing the sponge in a retracted, squeezed position between the rollers.

The litter picking device as shown in FIGS. 7 and 8 is comprised a hollow, tubular handle 80 having a housing 82 secured to the lower end thereof having four depending legs 84 similar to the housing 14 and legs 16 of the prior art structure shown in FIGS. 1 and 2. The housing 82 is of integral one piece construction with a sleeve 86 which surrounds the lower end of the hollow, tubular handle 80 and is secured thereto by a suitable means such as an adhesive or mechanical fastening device. A plate 88 is secured to the inner surface of the housing 82 by any suitable means such as nut and bolt assemblies 90 or to the end of the hollow, tubular handle 80. A rod 94 is secured in each of the four depending legs 84 similar to the manner in which the rods 18 and 20 are mounted in the legs 16 of the housing 14 as shown in the prior art embodiment of FIGS. 1 and 2. A support plate is provided with four upturned tabs 98 at each corner thereof through which the rods 94 extend. The rods 94 may be secured against any movement relative to the depending legs 84 and the upstanding tabs 98 by any suitable means such as welding or suitable abutments. One or more spikes are secured to the lower surface of the plate 96 for penetrating litter 102 which is to be picked up by the device. The spikes 100 may be secured to the plate 96 by any suitable means such as welding or by a screw connection such as disclosed in the embodiment of FIGS. 5 and 6.

An upwardly open housing 104 having four sides 106 and a bottom surface 108 has a number of apertures 110 equal to the number of spikes 100 through which the spikes pass. A pair of inwardly extending projections 112 are formed on the side walls 106 and a crossbar 114 extends between the projections 112 and is secured thereto by suitable screw means 118. The lower end of a rod 120 is secured to the crossbar 114 by means of welds 122 and extends coaxially with the hollow, tubular handle 80 through an aperture 124 in the plate 88. A plug 124 of plastics material having a central bore 128 is secured in the upper end of the hollow, tubular handle 80 with the upper end of the rod 120 disposed in the bore 228 for reciprocating movement therein. A spring 130 is mounted between the plate 88 and the crossbar 114 for normally biasing the housing 104 downwardly so that the bottom wall 108 thereof acts as a knock-off device for the litter.

A latch plate 132 having an aperture 134 with a diameter greater than the diameter of the rod 120 is pivoted on a support bracket 136 secured to one side of the handle 80 and extends through apertures 138 and 140 in opposite sides of the hollow, tubular handle 80. The rod 120 extends upwardly through the aperture 134 and a spring 142 normally biases the latch member 132 downwardly so that one edge of the aperture 134 is forced into frictional engagement with the rod 120.

In the operation of the litter picking device, the housing 104 which constitutes the litter knock-off means, is disposed in its lowermost position, as shown in FIG. 8, wherein the spike 100 is disposed completely within the housing to prevent inadvertent injury to people and objects. When it is desired to pick up a piece of litter such as the litter 102 illustrated in FIG. 7, it is only necessary to grasp the handle 80 and push the handle downwardly so that the spike 100 penetrates the litter 102, thereby forcing the knock-off housing 104 upwardly against the force of the spring 130 into the position shown in FIG. 7. This upward movement of the knock-off housing 104 causes the rod 120 to move upwardly through the aperture 134 wherein the latch plate 132 from the position shown in FIG. 8 to the position shown in FIG. 7. The force of the spring 142 on the latch 132 will pivot the latch member 132 into frictional binding relation with the rod 120 to prevent the downward movement of the knock-off housing 104 due to the force of the spring 130. However, when the spike 100 having the litter 102 impaled thereon is aligned with a suitable trash receptacle, the latch plate 132 can be pivoted upwardly against the force of the spring 142 to line the aperture 134 coaxially with the rod 120, thereby allowing the spring 130 to push the entire knock-off housing 104 downwardly, thereby ejecting the litter from the end of the spike 100.

The number of spikes on the plate 96 as well as the manner in which the spikes are interconnected with the plate may vary as in the previous embodiment. Likewise, the various materials used in the construction of the litter picking device may vary widely, but it is preferable that the force receiving parts such as the spike 100, the plate 96, the rods 94, the crossbar 114, the rod 120 and the latch plate 132 be made of metal. The other parts may be made of metal or plastic materials.

While the invention has been particularly shown and described with reference to the preferred embodiments thereof, it will be understood by those in the art that the foregoing and other changes in form and details may be made therein, without departing from the spirit and scope of the invention.

What is claimed is:

1. A litter picking conversion kit for converting a roller-sponge mop into a litter picking device wherein said roller-sponge mop is comprised of a hollow body of elongate tubular configuration, an operating handle adapted for axial reciprocating movement within the body between a working position and a sponge squeezing position, a pair of spaced apart parallel rollers secured to said body and a sponge assembly detachably connected to said handle for reciprocating movement between said rollers upon reciprocation of said handle; said conversion kit comprising:

an elongated U-shaped channel member adapted to fit over said parallel roller-sponge mop having the sponge assembly removed therefrom, securing means for connecting the U-shaped channel member to said rollers, spike means protruding downwardly from a base portion of said U-shaped channel member, an attachment bar extending parallel to and above said U-shaped channel member having means for detachably securing said bar to said handle of a conventional roller-sponge mop in lieu of a sponge assembly, a knock-off plate disposed adjacent said base portion of said U-shaped channel member having aperture means through which said spike means protrude, connecting means interconnecting said bar and said plate, and spring means disposed between said bar and said U-shaped channel member to normally bias said knock-off plate into engagement with said U-shaped channel member.

2. A conversion kit as set forth in claim 1, wherein said spike means is comprised of at least one spike having a pointed end and a threaded end detachably screwed into a threaded aperture in said base portion of said U-shaped channel member.

3. A litter picking device comprising:

a hollow, elongated, tubular handle having a housing secured at one end thereof, spike means connected to said housing and extending downwardly in a direction substantially parallel to a longitudinal axis of said handle, knock-off means slidably mounted for movement relative to said housing and having aperture means through which said spike means protrude, a rod secured to said knock-off means and extending coaxially through said hollow, tubular handle, latch means supported by said handle and engaging said rod for normally preventing axial movement of said rod in the direction of said spike means, and spring means for biasing said knock-off means away from said handle upon release of said latch means to discharge litter from said spike means;

wherein said latch means is comprised of a latch plate pivotally supported on said handle and extending transversely through said hollow, tubular handle with an aperture through which said rod extends with substantial clearance, spring means normally biasing said latch plate to bring an edge of said aperture into frictional engagement with said rod to allow movement of said rod in one direction relative to said latch plate whereby upon pivoting of said latch plate into a position substantially perpendicular to said rod, said rod will be free to move in both directions relative to said latch plate.

4. A litter picking device as set forth in claim 3, wherein said spike means is comprised of a pin-like member having a point at one end and a threaded connection at the opposite end for screw connection into a threaded aperture in said housing.

5. A litter picking device as set forth in claim 3, wherein said knock-off means is comprised of a box-like member having a bottom knock-off plate with said aperture means therein and upstanding side walls which cooperate with said housing to substantially enclose said spike means when biased away from said handle by said spring means to prevent accidental injury.

* * * * *